US005888024A

United States Patent [19]

Mills et al.

[11] Patent Number: 5,888,024

[45] Date of Patent: Mar. 30, 1999

[54] MARINE DOCK AND FLOTATION TANK

[75] Inventors: Edward D. Mills, Granton; David K. Broom, Crediton; Geofrey Grant Kime, London, all of Canada

[73] Assignee: Big "O" Inc., Exeter, Canada

[21] Appl. No.: 832,839

[22] Filed: Apr. 4, 1997

[51] Int. Cl.[6] ..... B63C 1/02

[52] U.S. Cl. ..... 405/219; 114/263; 114/266; 441/45

[58] Field of Search ..... 405/218, 219, 405/220, 221; 114/263, 266, 267, 283; 441/44, 45, 46; 138/121, 96 R, 89

[56] References Cited

U.S. PATENT DOCUMENTS

| | | | |
|---|---|---|---|
| 1,700,153 | 1/1929 | Bradley | 114/263 |
| 3,446,172 | 5/1969 | Morton et al. | 114/267 |
| 3,699,684 | 10/1972 | Sixt | 138/96 R |
| 4,303,104 | 12/1981 | Hegler et al. | 138/121 |
| 4,754,781 | 7/1988 | Jan de Putter | 138/121 |
| 4,799,445 | 1/1989 | Meriwether | 114/267 |
| 4,926,776 | 5/1990 | Corbet | 405/219 |
| 5,062,817 | 11/1991 | Wearne | 441/45 |
| 5,148,837 | 9/1992 | Agren et al. | 138/121 |

*Primary Examiner*—Tamara L. Graysay
*Assistant Examiner*—Frederick L. Lagman
*Attorney, Agent, or Firm*—Arne I. Fors

[57] ABSTRACT

A floating dock comprising a pair of flotation tanks arranged in parallel side-by-side relation, a plurality of transverse, equispaced double-saddle brackets having a pair of spaced-apart saddles each adapted to receive a flotation tank straddling said tanks along the length of the tanks, and connector means adapted to partially encircle each tank and to seat in a recess between corrugations extending from each saddle for connecting the tanks to the saddle brackets. The flotation tank comprises a cylindrical smooth inner wall and a corrugated outer wall coextensive and concentric with said inner wall defining a plurality of equispaced peripheral annular flotation cells extending along the inner cylindrical wall, and a closure plate at each end of the cylindrical walls connected to the inner and outer walls in a water-tight relationship defining a central flotation cell. The outer corrugated wall has a plurality of peripheral recesses extending circumferentially around said outer wall along the length of the outer wall. The floating dock has longitudinal side planks and a top deck, preferably a wood deck extending between and attached to the longitudinal side planks. The floating dock additionally may include one or more floating finger docks connected to a side of the floating dock perpendicular or parallel thereto.

5 Claims, 5 Drawing Sheets

MARINE DOCK AND FLOTATION TANK

BACKGROUND OF THE INVENTION (i) Field of The Invention

This invention relates to a floating marine dock and, more particularly, relates to a novel flotation tank and tank assembly system for use in a floating dock.

(ii) Description of the Related Art

Shorelines subjected to tides, spring flooding and large waves require floating docks to allow compensation for changes in water level. The floating docks often are attached to the shore by a vertically pivotal ramp which allows the docks to rise and fall as the water level changes.

Conventional floating docks, well known in the art, typically comprise a wood or steel frame with wood decking and flotation units housed in the frame beneath the decking. Typical floating units are rectangular, close-celled foam slabs such as rigid styrofoam, steel or plastic drums, and molded rectangular plastic compartments. Foam slabs are difficult to attach to the dock frame and often are detached and lost during storms, or are destroyed by muskrats and the like water dwelling rodents who bore into the foam to make nests. Drums also can be difficult to attach, and if perforated by rust or by impact with a sharp object, will be flooded, lose their buoyancy and sink. Molded plastic compartments are expensive to form and, if punctured, will be flooded and sink.

It a principal object of the present invention to provide an inexpensive plastic flotation tank which can be manufactured in any desired length and diameter and which can be readily and securely attached to a deck frame.

It is another important object of the present invention to provide a flotation tank which has a plurality of peripheral flotation cells which surround and protect a central flotation cell. A further object of the invention is the provision of a floating marine dock system which can be readily modified into a variety of finger dock configurations. These and other objects of the invention, and the manner in which they can be attained, will become apparent as the description proceeds.

SUMMARY OF INVENTION

In its broad aspect, the flotation tank of the invention comprises a cylindrical smooth inner wall and a corrugated outer wall coextensive and concentric with said inner wall defining a plurality of equispaced peripheral annular flotation cells extending along the inner cylindrical wall, and a closure plate at each end of the cylindrical walls connected to the inner and outer walls in a water-tight relationship defining a central flotation cell. The outer corrugated wall has a plurality of peripheral recesses extending circumferentially around said outer wall along the length of the outer wall. In a preferred aspect of the invention, the floating dock comprises a pair of said flotation tanks arranged in parallel side-by-side relation, a plurality of transverse, equispaced double-saddle brackets having a pair of spaced-apart saddles each adapted to receive a flotation tank straddling said tanks along the length of the tanks, and connector means adapted to partially encircle each tank and to seat in a recess between corrugations extending from each saddle for connecting the tanks to the saddle brackets. Each connector means comprises a semi-circular rod having threaded ends, said rods having a diameter substantially equal to the diameter of the outer wall circumferential recesses for seating in said recesses, and a nut threaded onto each end of the rod for removably securing each end of the rod to a saddle. Each saddle bracket has a top horizontal support member and vertical opposite side support members for receiving longitudinal side planks and a top deck, preferably a wood deck extending between and attached to the longitudinal side planks.

In accordance with another aspect of the invention, the floating dock additionally comprises a floating finger dock, said floating finger dock comprising an elongated flotation tank, a plurality of single saddle brackets equispaced along said tank, means for securing said saddle brackets to the elongated tank, each saddle bracket having a top horizontal support member and vertical opposite side support members for receiving longitudinal side planks and a top deck, and means for connecting said finger dock to a side of the floating dock perpendicular or parallel thereto.

BRIEF DESCRIPTION OF THE DRAWINGS

The description will now proceed with reference to the accompanying drawings, in which.

DETAILED DESCRIPTION OF THE PREFERRED EMBODIMENT

Figure 1:
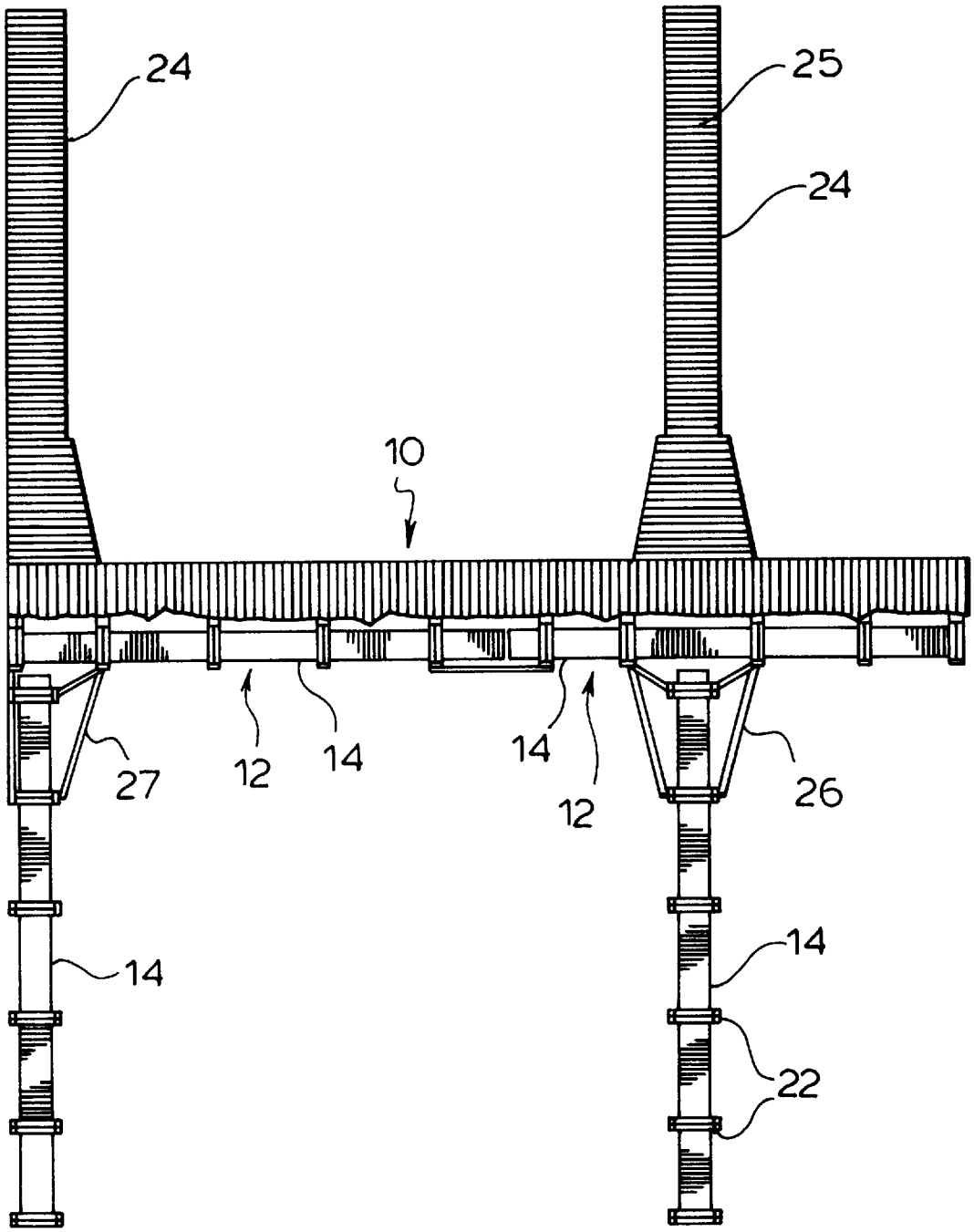
FIG. 1 is a top plan view, partly cut away for purposes of illustration, of a dock system of the present invention comprising a main dock with finger docks.
Figure 2:
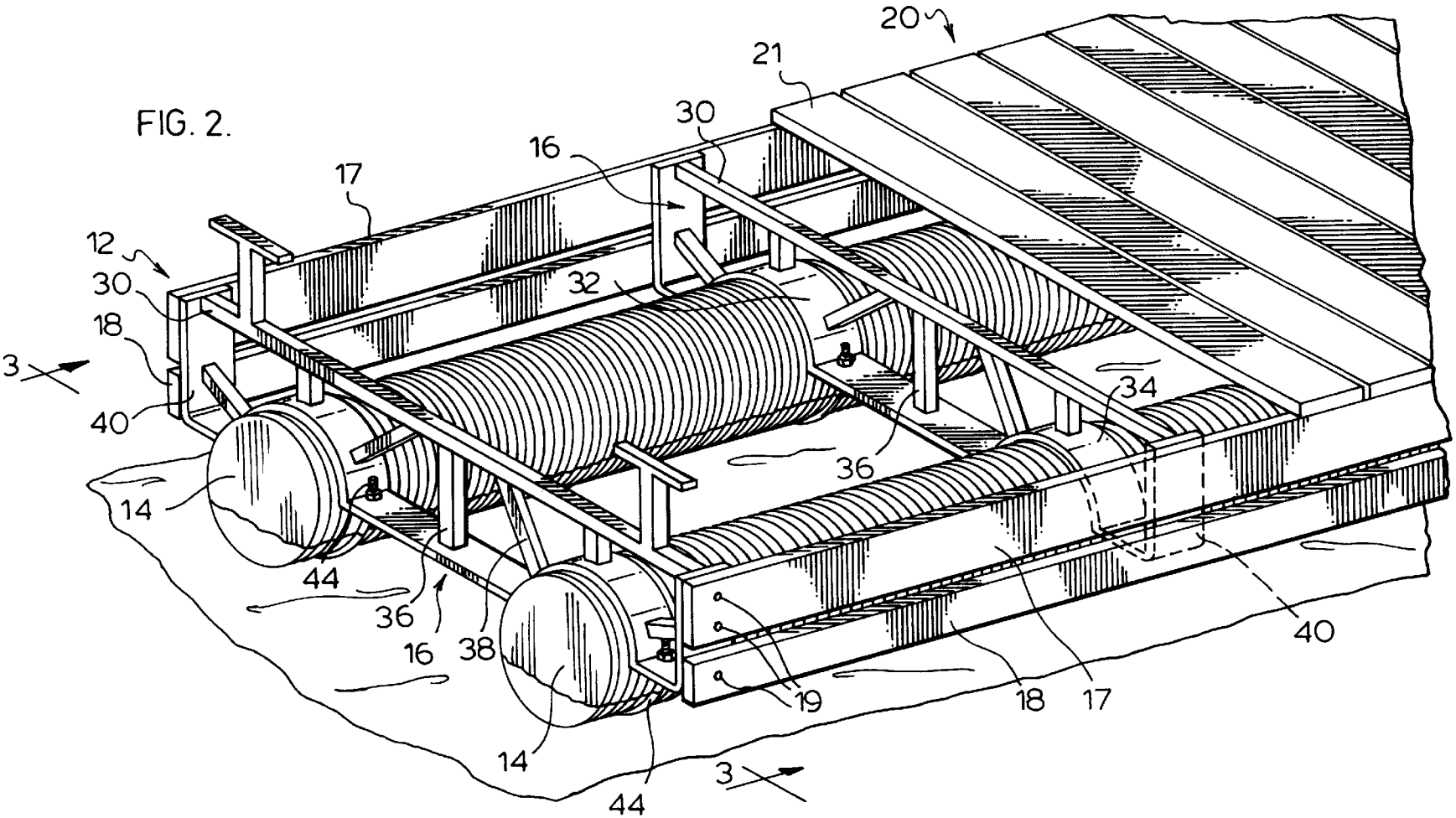
FIG. 2 is an enlarged view of a central portion of the main dock shown in FIG. 1 with decking partially removed.
Figure 3:
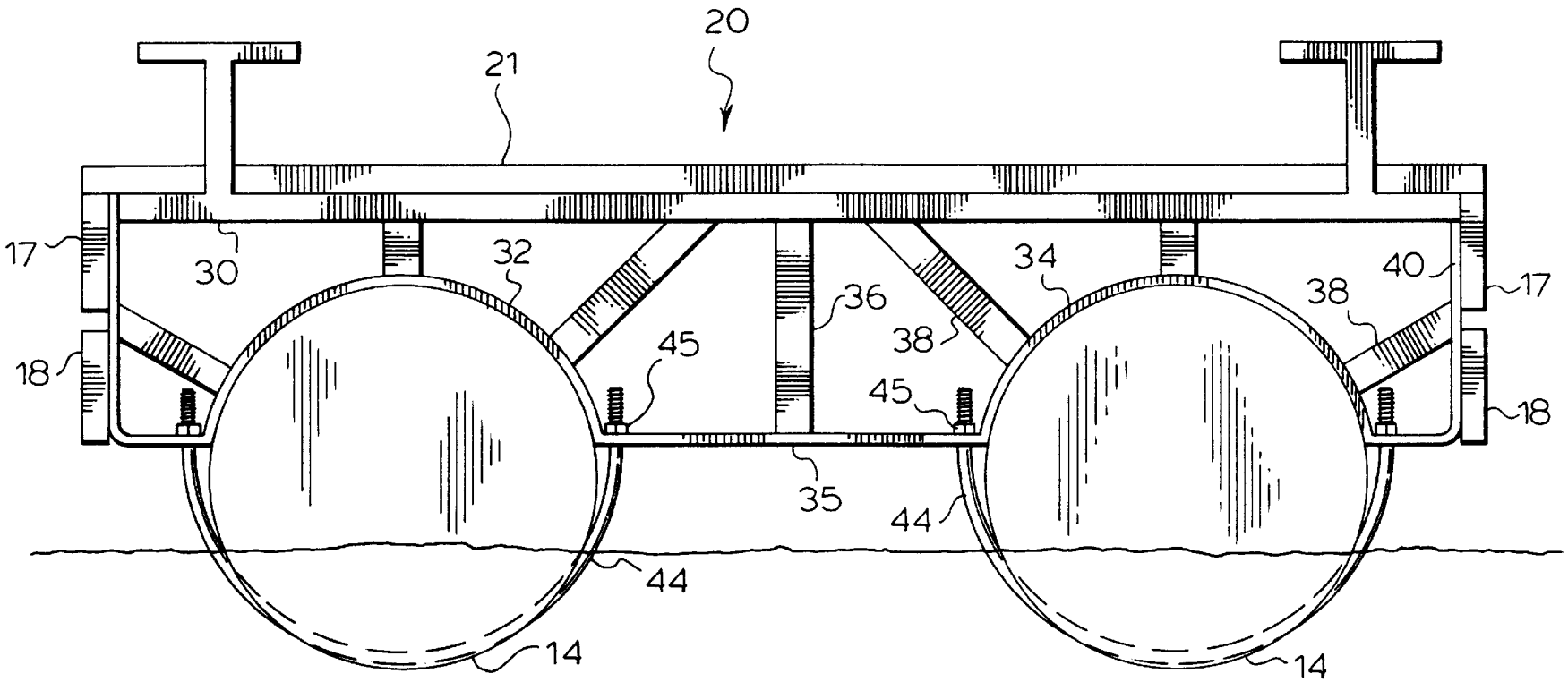
FIG. 3 is a vertical section taken along line 3—3 of FIG. 2 showing a double saddle bracket.

With reference first to FIGS. 1, 2 and 3 of the drawings, the dock system of the present invention comprises a main dock 10 consisting of one or a plurality of modular sections 12 joined end to end. Each modular dock section 12 comprises a pair of parallel elongated flotation tanks 14 about 18 inches in diameter and about 15 feet long secured a spaced distance apart along their lengths by equispaced double saddle brackets 16 which straddle said tanks and are connected thereto. Each adjacent pair of double saddle brackets 16 is inter-connected at about 5 foot intervals along each side of the dock by a pair of longitudinally extending side wood planks 17, 18 secured to the saddle brackets by bolts 19. A deck 20, shown on one half only of main dock section 12 in FIG. 1 for clarity of description, is comprised of transverse wood planks 21 secured to longitudinal wood side planks 17.

Elongated finger docks 24 each comprise a single flotation tank 14 having a plurality of equispaced single saddle brackets 22 secured along its length for support of a deck 25 and is joined to main dock 10 by brackets 26, 27 to be described.

With particular reference now to FIGS. 2 and 3, each double saddle bracket 16 comprises an upper transverse tubular member 30 positioned over a pair of spaced apart semi-circular saddles 32, 34 having a diameter suitable to mate with and engage the outside diameter of tanks 14. Saddles 32,34 are formed from stiff ¼-inch thick 8 inch wide elongated steel plates 35 and are secured such as by welds to the transverse top member 30 by vertical and diagonal radial tubular struts 36, 38, and at each end by vertical flange plates 40. Transverse, equispaced wooden planks 21 are bolted or nailed to longitudinal side planks 17 to form an upper deck 20.

Each tank 14 is connected to the underside of brackets 16 in a saddle 32 or 34 by semi-circular steel rods 44 that are threaded at each end and are secured by nuts 45 to bracket plate 35. The steel rods 44 are seated in the hollows of the corrugations of the tanks to securely lock the tanks in place to prevent axial movement.

Figure 4:
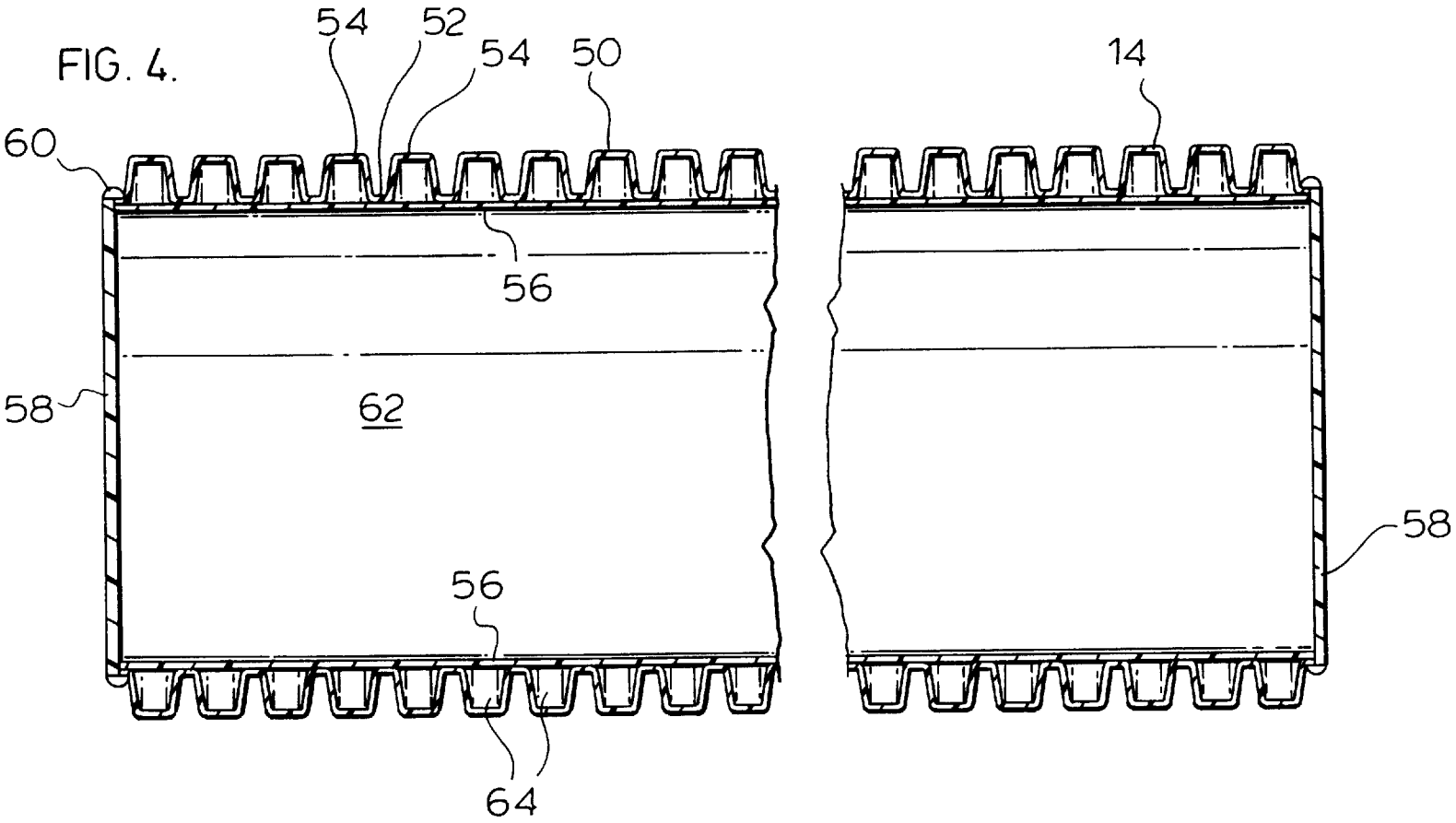
FIG. 4 is a longitudinal section of a flotation tank of the present invention.

Turning now to FIG. 4, each tank 14 is double walled and comprises a generally cylindrical corrugated outer wall 50 having circumferential peripheral recesses 52 formed between corrugations 54. A smooth cylindrical inner wall 56 is joined to the corrugated outer wall 50 at each of the recesses 52 by fuse welds formed during extrusion and vacuum molding of the composite tank wall. An end plate 58 is welded by weld 60 continuously about the perimeter of plate 58 to each end of the outer pipe wall 50 to form a water-tight tank.

Each flotation tank 14 comprises a central main flotation cell 62 and a multiplicity of secondary, isolated equispaced peripheral flotation cells 64 along its length defined between inner wall 56 and each corrugation 54. Each tank thus has double-walled peripheral protection with independent isolated flotation cells 64 formed around the tank perimeter to protect against puncture while providing reserve flotation. Turning now to the embodiment of FIG. 5, in which the wood side members and decking are removed to show the sub-structure, flotation tanks 14 are shown arranged in parallel, side-by-side relationship to form main dock 10 with a pair of spaced-apart double-saddle brackets 16 interconnecting a pair of tanks 14. A first embodiment of finger dock 20, having tank 14*a* without upper decking, is shown connected to a main dock 10 by a T-bracket 70 having a transverse member 72 which is pinned at each end by bolts 74 passing through flanges 75 of brackets 16. A pair of diagonal links 76 connected to annular single saddle brackets 78 position the end of finger dock 20 from dock 10. Diagonal links 80 connected to transverse link 72 adjacent the main dock at the one and attached to single saddle connector bracket 82 at the other end anchor the finger dock 20 perpendicular to main dock.

Figure 5:
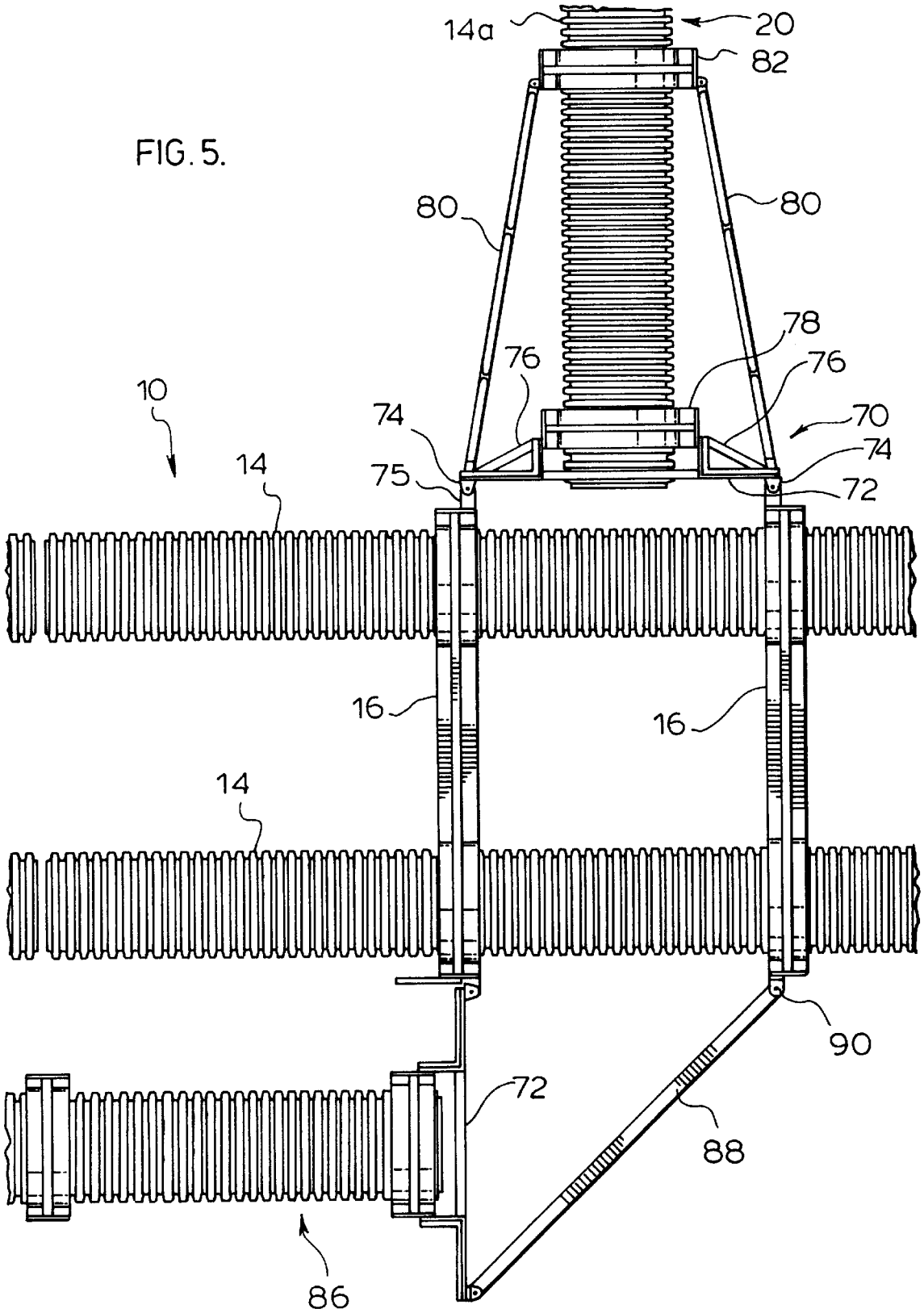
FIG. 5 is a top plan view of a further embodiment of the system of the present invention.

A second embodiment 86 of finger dock is shown in FIG. 5 wherein an extended link 88 positions the finger dock 86 parallel to the main dock 10, link 88 being connected at one end to transverse frame 72 and connected at the other end to double saddle bracket 16 at 90.

The present invention provides a number of important advantages. Each flotation tank can be formed by extrusion of a plastics materials such as polyethylene used for corrugated pipe in any desired diameter produced for pipe and cut to a suitable length. Although the description has proceeded with reference to 18-inch diameter tanks 15 feet in length, it will be understood that the diameter of the tanks can vary from 12 inches to 48 inches and larger and the length of the tanks can range from 8 to 25 feet and longer. A closure end plate can be easily welded on to both ends of each pipe section to form a main flotation cell section. A plurality of equispaced secondary peripheral cells which are isolated from the central main flotation cell are provided by the corrugations to provide protection to the main flotation cell while affording secondary flotation. The tanks can be easily incorporated into a dock structure which in turn can be configured into a variety of shapes and sizes.

It will be understood, of course, that modifications can be made in the embodiments of the invention illustrated and described herein without departing from the scope and purview of the invention as defined by the appended claims.

We claim:

1. A floating dock comprising a pair of flotation tanks arranged in parallel side-by-side relation, each said flotation tank comprising a cylindrical smooth inner wall and a corrugated outer wall coextensive and concentric with said inner wall defining a plurality of equispaced peripheral annular flotation cells extending along the inner cylindrical wall and a plurality of peripheral recesses extending circumferentially around said outer wall along the length of the outer wall and a closure plate at each end of the cylindrical walls connected to the outer wall in a water-tight relationship defining a central flotation cell, a plurality of transverse, equispaced double-saddle brackets having a pair of spaced-apart saddles each adapted to receive a flotation tank straddling said tanks along the length of the tanks, and connector means adapted to partially encircle each tank and to seat in a recess between corrugations extending from each saddle for connecting the tanks to the saddle brackets.

2. A floating dock as claimed in claim 1 in which said connector means each comprise a semi-circular rod having threaded ends, said rods having a diameter substantially equal to the diameter of the outer wall circumferential recesses for seating in said recesses, and a nut threaded onto each end of the rod for removably securing each end of the rod to a saddle.

3. A floating dock as claimed in claim 2 in which a plurality of said double saddle brackets are equispaced and connected along said pair of flotation tanks, each saddle bracket having a top horizontal support member and opposite vertical side support members, and additionally comprising longitudinally extending side planks secured to the side support members.

4. A floating dock as claimed in claim 3, in which additionally comprising a wood decking extending between and attached to the longitudinally extending side planks.

5. A floating dock as claimed in claim 4, additionally comprising a floating finger dock, said floating finger dock comprising an elongated flotation tank having a cylindrical smooth inner wall and a corrugated outer wall coextensive and concentric with said inner wall defining a plurality of equispaced peripheral annular flotation cells extending along the inner cylindrical wall, and a closure plate at each end of the cylindrical walls connected to the outer wall in a water-tight relationship defining a central flotation cell, said outer corrugated wall having a plurality of peripheral recesses extending circumferentially around said outer wall along the length of the outer wall, a plurality of equispaced single saddle brackets equispaced along said tank, each saddle bracket having a top horizontal support member and vertical opposite side support members, means for securing said saddle brackets to the elongated tank, longitudinally extending side members and means for attaching said side members to the vertical side support members, a wood deck extending between and secured to the longitudinally extending side members and means for connecting said finger dock to a side of the floating dock perpendicular or parallel thereto.

* * * * *